US006883941B2

(12) United States Patent
Cutting

(10) Patent No.: US 6,883,941 B2
(45) Date of Patent: Apr. 26, 2005

(54) LANDSCAPE LIGHT FIXTURE

(76) Inventor: Steven B. Cutting, 41-521 Trinity Cir., Bermuda Dunes, CA (US) 92201

( * ) Notice: Subject to any disclaimer, the term of this patent is extended or adjusted under 35 U.S.C. 154(b) by 297 days.

(21) Appl. No.: 10/251,826

(22) Filed: Sep. 23, 2002

(65) Prior Publication Data

US 2004/0057237 A1 Mar. 25, 2004

(51) Int. Cl.[7] ..... H01J 31/00

(52) U.S. Cl. ..... 362/371; 362/352; 362/359; 315/56; 315/57

(58) Field of Search ..... 362/371, 352, 362/359, 427, 198, 199; 315/56–58

(56) References Cited

U.S. PATENT DOCUMENTS

| | | | | |
|---|---|---|---|---|
| 4,052,608 A | | 10/1977 | Papenmeier | 362/368 |
| 4,604,552 A | | 8/1986 | Alley et al. | 315/176 |
| 4,758,934 A | | 7/1988 | von Kohorn | 362/145 |
| 4,876,487 A | | 10/1989 | Yang | 315/362 |
| 4,906,901 A | | 3/1990 | Carroll | 315/297 |
| 4,992,917 A | | 2/1991 | Earnshaw | 362/346 |
| 5,087,861 A | | 2/1992 | Boyd et al. | 315/247 |
| 5,160,202 A | | 11/1992 | Légaré | 362/153.1 |
| 5,178,454 A | | 1/1993 | Lai | 362/431 |
| 5,187,411 A | | 2/1993 | Boyd et al. | 315/247 |
| 5,280,417 A | | 1/1994 | Hall et al. | 362/226 |
| 5,286,216 A | | 2/1994 | Volz | 439/236 |
| 5,424,610 A | | 6/1995 | Pelton et al. | 315/58 |
| 5,477,442 A | | 12/1995 | Self | 362/368 |
| 5,510,970 A | * | 4/1996 | Hollenbach et al. | 362/396 |
| 5,526,243 A | | 6/1996 | Masters | 362/122 |
| 5,649,760 A | | 7/1997 | Beadle | 362/270 |
| 5,738,436 A | | 4/1998 | Cummings et al. | 362/294 |
| D395,726 S | | 6/1998 | Pink et al. | D26/68 |
| 5,803,594 A | | 9/1998 | Frederickson et al. | 362/351 |
| 5,831,391 A | | 11/1998 | MacKay | 315/159 |
| 5,833,359 A | * | 11/1998 | Hollenbach | 362/250 |
| 5,890,797 A | * | 4/1999 | Bish | 362/419 |
| 5,964,522 A | * | 10/1999 | Schaefer et al. | 362/350 |
| 6,176,598 B1 | * | 1/2001 | Seligman et al. | 362/352 |
| 6,206,545 B1 | | 3/2001 | Yan | 362/249 |
| 6,290,375 B1 | | 9/2001 | LeVasseur | 362/368 |
| 6,612,720 B1 | * | 9/2003 | Beadle | 362/287 |
| 6,727,664 B2 | * | 4/2004 | Miller et al. | 315/224 |

FOREIGN PATENT DOCUMENTS

| | | |
|---|---|---|
| EP | 0 101 147 A2 | 2/1984 |

* cited by examiner

*Primary Examiner*—Tuyet Thi Vo
(74) *Attorney, Agent, or Firm*—Richard C. Litman

(57) ABSTRACT

A landscape light fixture to illuminate aesthetically desirable lighting. The landscape light fixture includes a ballast housing, a shroud, a light bulb, a lens, and a power cord with a connector. The landscape light fixture may also include a neck, a pivot, at least one mounting element, and at least one spacer.

17 Claims, 24 Drawing Sheets

LANDSCAPE LIGHT FIXTURE

BACKGROUND OF THE INVENTION

1. Field of the Invention

The present invention relates to landscape light systems, and more particularly to a landscape light fixture that illuminates aesthetically desirable lighting.

2. Description of the Related Art

Many different types of outdoor light fixtures are known in the art. However, many of these light fixtures use incandescent light sources which consume more power and last less time than fluorescent light sources. When fluorescent light sources are employed, they typically provide undesirable light quality, such as glare or the like. The related art is represented by the following references of interest.

U.S. Design Pat. No. 395,726, issued on Jun. 30, 1998 to Anthony N. Pink et al., shows an ornamental design for an outdoor light fixture. Pink et al. does not suggest a landscape light fixture according to the claimed invention.

U.S. Pat. No. 4,052,608, issued on Oct. 4, 1977 to Horst Papenmeier, describes an inspection glass light for the illumination and simultaneous observation of working operations in closed spaces. Papenmeier does not suggest a landscape light fixture according to the claimed invention.

U.S. Pat. No. 4,604,552, issued on Aug. 5, 1986 to Robert P. Alley et al., describes a retrofit fluorescent lamp energy management/dimming system. Alley et al. does not suggest a landscape light fixture according to the claimed invention.

U.S. Pat. No. 4,758,934, issued on Jul. 19, 1988 to Henry von Kohorn, describes an illuminated rock garden. von Kohorn does not suggest a landscape light fixture according to the claimed invention.

U.S. Pat. No. 4,876,487, issued on Oct. 24, 1989 to Jerry S. C. Yang, describes a low voltage illuminating lamp set with a programmable output for garden use which is used to control the lamp set in a garden. Yang does not suggest a landscape light fixture according to the claimed invention.

U.S. Pat. No. 4,906,901, issued on Mar. 6, 1990 to David T. Carroll, describes a power supply for outdoor lighting systems that accepts ordinary household alternating current and converts this current into a lower voltage at a higher frequency. Carroll does not suggest a landscape light fixture according to the claimed invention.

U.S. Pat. No. 4,992,917, issued on Feb. 12, 1991 to John Earnshaw, describes a light reflector for growing plants. Earnshaw does not suggest a landscape light fixture according to the claimed invention.

U.S. Pat. Nos. 5,087,861 and 5,187,411, issued on Feb. 11, 1992 and Feb. 16, 1993, respectively, to Dudley G. Boyd et al., describe a discharge lamp life and lamp lumen life-extender module, circuitry, and methodology. Boyd et al. '861 and '411 do not suggest a landscape light fixture according to the claimed invention.

U.S. Pat. No. 5,160,202, issued on Nov. 3, 1992 to Luc R. Légaré, describes a concrete curbstone block provided with an internal illuminated housing for projecting light onto a driveway. Légaré does not suggest a landscape light fixture according to the claimed invention.

U.S. Pat. No. 5.178,454, issued on Jan. 12, 1993 to Wei-Cheng Lai, describes a decorative lamp post. Lai does not suggest a landscape light fixture according to the claimed invention.

U.S. Pat. No. 5,280,417, issued on Jan. 18, 1994 to Milly S. Hall et al., describes a low voltage light fixture. Hall et al. does not suggest a landscape light fixture according to the claimed invention.

U.S. Pat. No. 5,286,216, issued on Feb. 15, 1994 to George A. Volz, describes a retrofit system for converting and dedicating a high energy consuming incandescent lighting system to an energy efficient lighting system. Volz does not suggest a landscape light fixture according to the claimed invention.

U.S. Pat. No. 5,477,442, issued on Dec. 19, 1995 to Margaret A. Self, describes a light fixture for use in hazardous locations and adverse environments that includes a mounting plate and a first ballast housing. A second non-interchangeable ballast housing may be alternately employed by use of an adapter ring removably securable intermediate the mounting plate and the second ballast housing. Self does not suggest a landscape light fixture according to the claimed invention.

U.S. Pat. No. 5,424,610, issued on Jun. 13, 1995 to Bruce A. Pelton et al., describes an outboard ballast which allows a compact fluorescent light bulb and its associated ballast to be positioned within a standard table lamp having a standard-size harp. Pelton et al. does not suggest a landscape light fixture according to the claimed invention.

U.S. Pat. No. 5,526,243, issued on Jun. 11, 1996 to Jack W. Masters, describes a decorative enclosure or cover that is adjustably fitted over a low voltage light fixture. Masters does not suggest a landscape light fixture according to the claimed invention.

U.S. Pat. No. 5,649,760, issued on Jul. 22, 1997 to Joshua Z. Beadle, describes a lighting fixture that includes a housing and a reflector assembly in the housing seated in a split, resilient sealing ring and retained by a resilient retaining clip. Beadle does not suggest a landscape light fixture according to the claimed invention.

U.S. Pat. No. 5,738,436, issued on Apr. 14, 1998 to John H. Cummings et al., describes a modular lighting fixture. Cummings et al. does not suggest a landscape light fixture according to the claimed invention.

U.S. Pat. No. 5,803,594, issued on Sep. 8, 1998 to Linda L. Frederickson et al., describes a method and outdoor light accessory for enhancing the appearance of landscape lighting. Frederickson et al. does not suggest a landscape light fixture according to the claimed invention.

U.S. Pat. No. 5,831,391, issued on Nov. 3, 1998 to Iain N. B. MacKay, describes an outdoor ground lighting system that includes one or more low voltage lamp units, provided from a step down transformer connectable to a high voltage AC power supply and an on/off timer operative to turn the lamps on for a selected time period during hours of darkness. MacKay does not suggest a landscape light fixture according to the claimed invention.

U.S. Pat. No. 6,206,545 B1, issued on Mar. 27, 2001 to Ellis Yan, describes an enhanced safety system for the conversion of luminaria that uses halogen lighting technology to a safe and efficient fluorescent lighting system. Yan does not suggest a landscape light fixture according to the claimed invention.

U.S. Pat. No. 6,290,375 B1, issued on Sep. 18, 2001 to Craig LeVasseur, describes a ballast housing having pivotally engaging mounting means. LeVasseur does not suggest a landscape light fixture according to the claimed invention.

European Patent document 0 101 147 A2, published on Feb. 22, 1984, describes a lighting apparatus suitable for general gardening and courtyard lighting. European '147 does not suggest a landscape light fixture according to the claimed invention.

None of the above inventions and patents, taken either singularly or in combination, is seen to describe the instant invention as claimed.

SUMMARY OF THE INVENTION

The present invention is a landscape light fixture. The landscape light fixture includes a ballast housing, a shroud, a light bulb, a lens, and a power cord with a connector. The landscape light fixture may also include a neck, a pivot, at least one mounting element, and at least one spacer.

The ballast housing includes a front end, a rear end, and a side. The ballast housing is configured to house a ballast or power stabilizing circuit that converts externally received electrical power to a predetermined electrical form for the landscape light fixture. The ballast housing may be made of any durable material according to the desires of the user. The front and rear ends of the housing may include apertures defined therein that allow one or more mounting elements to pass therethrough to mount the ballast housing to a support. At least one spacer may be employed to space the ballast housing from a support according to the desires of the user. The spacers may be made from any durable material.

The shroud includes a base through which an electrical conductor passes and connects to a light socket. The base may include apertures defined therein that allow one or more fastening elements to pass therethrough. A pivot may be attached to and/or extend from the base and may be configured to adjustably receive a mounting element to mount the base to any desirable support, such as a tree, building, etc. A transparent or translucent cylindrically shaped lens is attached to the base and extends for a predetermined distance from the base. The lens contains therein and protects the light bulb from environmental damage and may be colored according to the desires of the user.

The shroud may also include at least one member that longitudinally extends from the base. This member may be configured to allow light emitted from the light bulb to be directed according to the desires of the user. Reflective material may be attached to the longitudinally extending member to reflect light emitted from the light bulb to the environment.

The light bulb may be a fluorescent light to produce aesthetic lighting to landscape areas. The light bulb may be a cylindrical glass element with an electrical connector at one end configured to electrically connect to the light socket of the shroud. The light bulb may be dimensioned according to the desires of the user.

The power cord enables the landscape light fixture to receive external power through an external power cord and connector.

The landscape light fixture may include a,neck to interconnect the ballast housing with the shroud. Such a neck may be attached to the rear end of the ballast housing and contains electrical conductors that pass therethrough to electrically connect the ballast to the light socket of the shroud. The neck may be curved or straight according to the desires of the user. One end of the neck may include a flexible portion configured to allow adjustment of the ballast housing and/or shroud. The neck may be made of any durable material according to the desires of the user.

Accordingly, it is a principal aspect of the invention to provide a landscape light fixture including a ballast housing, a ballast mounted within the ballast housing, a shroud interconnected with the ballast, a light bulb electrically connected to the ballast and contained within the shroud, a lens covering the light bulb, and a power cord with a connector electrically connected to the ballast.

It is another aspect of the invention to provide a landscape light fixture including a ballast housing, a ballast mounted within the ballast housing, a shroud interconnected with the ballast, a light bulb electrically connected to the ballast and contained within the shroud, a lens covering the light bulb, and a power cord with a connector electrically connected to the ballast, wherein the shroud includes an inner surface and an outer surface, and reflective material is attached to the inner surface of the shroud to reflect light from the light bulb to the environment.

Still another aspect of the invention to provide a landscape light fixture including a ballast housing, a ballast mounted within the ballast housing, a shroud interconnected with the ballast, a light bulb electrically connected to the ballast and contained within the shroud, a lens covering the light bulb, and a power cord with a connector electrically connected to the ballast, wherein the light bulb is a fluorescent light to produce aesthetic desirable lighting.

It is an aspect of the invention to provide improved elements and arrangements thereof in a landscape light fixture for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
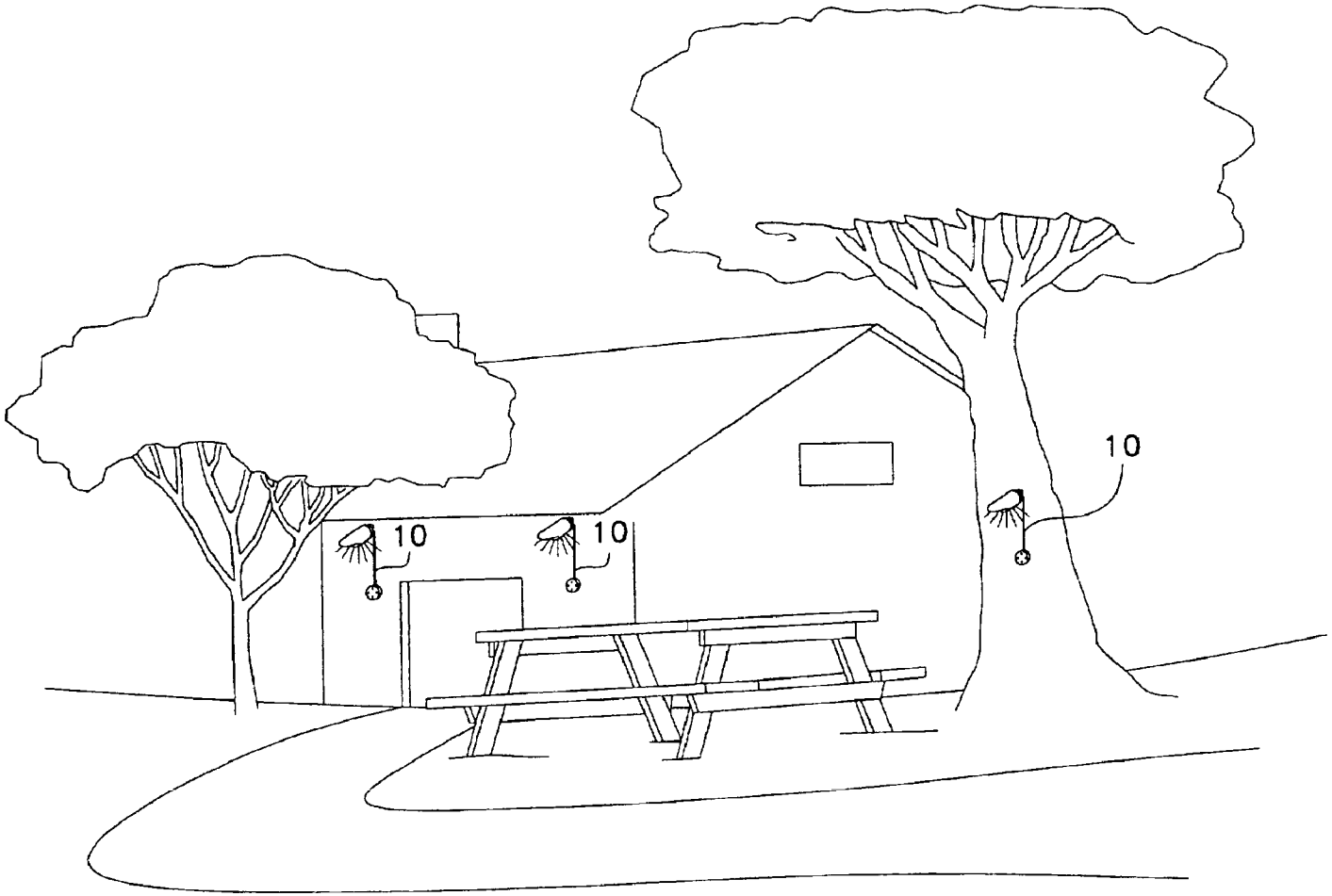
FIG. 1 is an environmental, perspective view of a landscape light fixture according to the present invention.

The present invention is a landscape light fixture. The invention disclosed herein is, of course, susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

Figure 2:
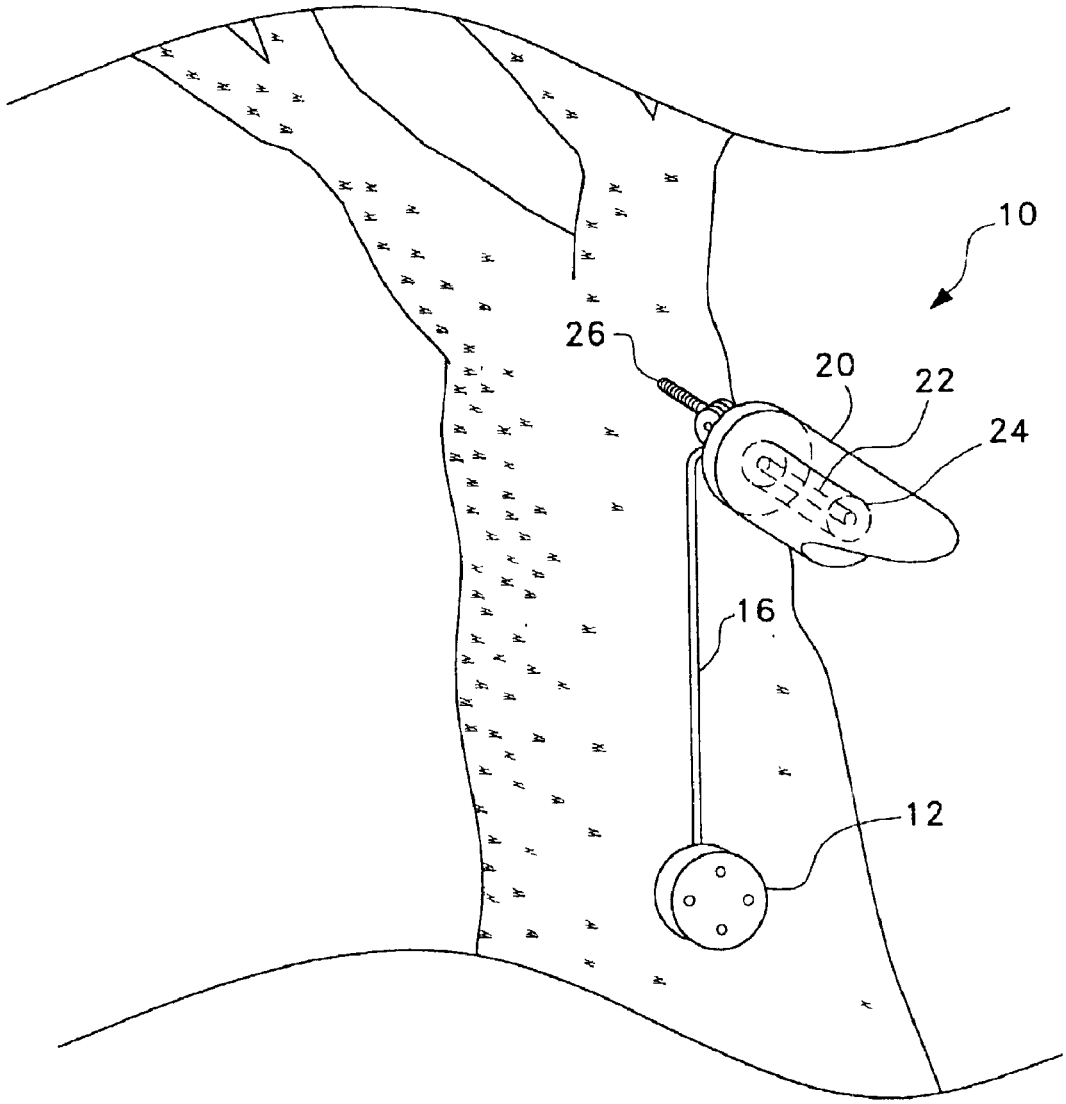
FIG. 2 is a front perspective view of a landscape light fixture according to the present invention.
Figure 3:
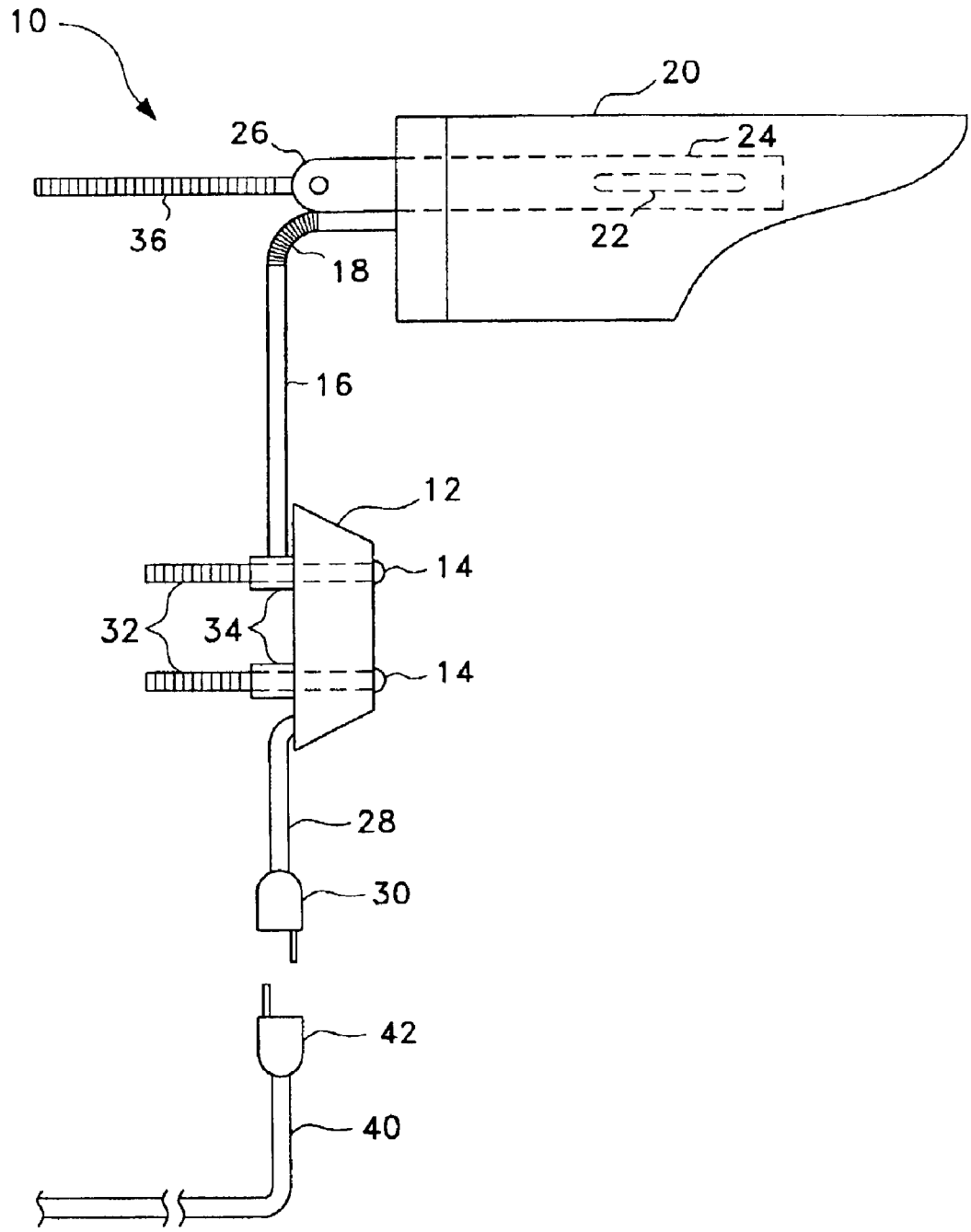
FIG. 3 is a side view of a landscape light fixture according to the present invention.

Referring to the drawings, FIGS. 1–3 illustrate a backyard of a house and a landscape light fixture 10 according to the invention. Landscape light fixtures 10 are mounted on the house and on a tree. Landscape light fixture 10 includes a ballast housing 12, a shroud 20, a light bulb 22, a lens 24, and a power cord 28 with a connector 30. Landscape light fixture 10 may also include a neck 16, a pivot 26, at least one mounting element 32, 36, and at least one spacer 34.

As illustrated in FIGS. 2 and 3, ballast housing 12 includes a front end, a rear end, and a side. Ballast housing 12 is configured to house a ballast or power stabilizing circuit that converts externally received power to a predetermined form for the landscape light fixture. For example, 12 volt, 60 Hz power provided from electrical power cord 40 and connector 42 by an external power source may be converted into a high frequency AC form for the landscape light fixture by the ballast. Ballast housing 12 may be made of any durable material according to the desires of the user. For example, ballast housing 12 may be made of decorative metal material, such as copper or the like, or decorative plastic material. The front and rear of ballast housing 12 may include apertures defined therein that allow at least one mounting element 32, such as a screw, nail, or the like, to pass therethrough to mount ballast housing 12 to a support, such as a tree, a wall, etc. At least one spacer 34 may be employed to space the ballast housing from a support according to the desires of the user. The at least one spacer 34 may be made from any durable material according to the desires of the user.

Shroud 20 includes a base through which an electrical conductor passes and connects to a light socket (not shown). The base may include apertures defined therein that allow one or more fastening elements (not shown) to pass therethrough. A pivot 26 may be attached to and/or extend from the base and may be configured to adjustably receive mounting element 36 to mount the base to any desirable support, such as a tree, a building, etc. A transparent or translucent cylindrically shaped lens 24 is attached to the base and extends for a predetermined distance from the base. Lens 24 protects light bulb 22 from environmental damage and may be made of rugged polycarbonate material, such as LEXAN or the like, and may be colored according to the desires of the user.

Shroud 20 may also include at least one member that longitudinally extends from the base. This member may be configured to allow light emitted from light bulb 22 to be directed according to the desires of the user. The longitudinally extending member illustrated in FIGS. 1–3 allows light emitted light bulb 22 to be directed downward. However, such a member, if included with the shroud, may be configured in any manner according to the desires of the user. For example, such a member may be configured to allow light from a light bulb to be directed upward, downward, upward and downward, sideways, etc. Reflective material may be attached to the longitudinally extending member to reflect light from light 22 to the environment.

Light bulb 22 may be a fluorescent light to produce aesthetic lighting to a landscape area. For example, light bulb 22 may be configured to produce moonlight lighting to the backyard of a residence. Light bulb 22 may be a cylindrical glass element with an electrical connector at one end configured to electrically connect to the light socket of the shroud. Light bulb 22 may be dimensioned according to the desires of the user.

Power cord 28 enables landscape light fixture 10 to receive external power through an external power cord 40 and connector 42.

Landscape light fixture 10 may include neck 16 to interconnect the ballast housing with the shroud. Such a neck 16 may be attached to the rear end of ballast housing 12. However, neck 16 may interconnect ballast housing 12 and shroud 20 according to the desires of the user. Neck 16 includes contained therein electrical conductors, such as wire, that pass therethrough to electrically connect the ballast to light socket of the shroud. Neck 16 may be straight or curved according to the desires of the user. One end of neck 16 may include a flexible portion 18 configured to allow adjustment of light bulb 22. Neck 16 is connected to shroud 20 for landscape light fixture 10.

Figure 4:
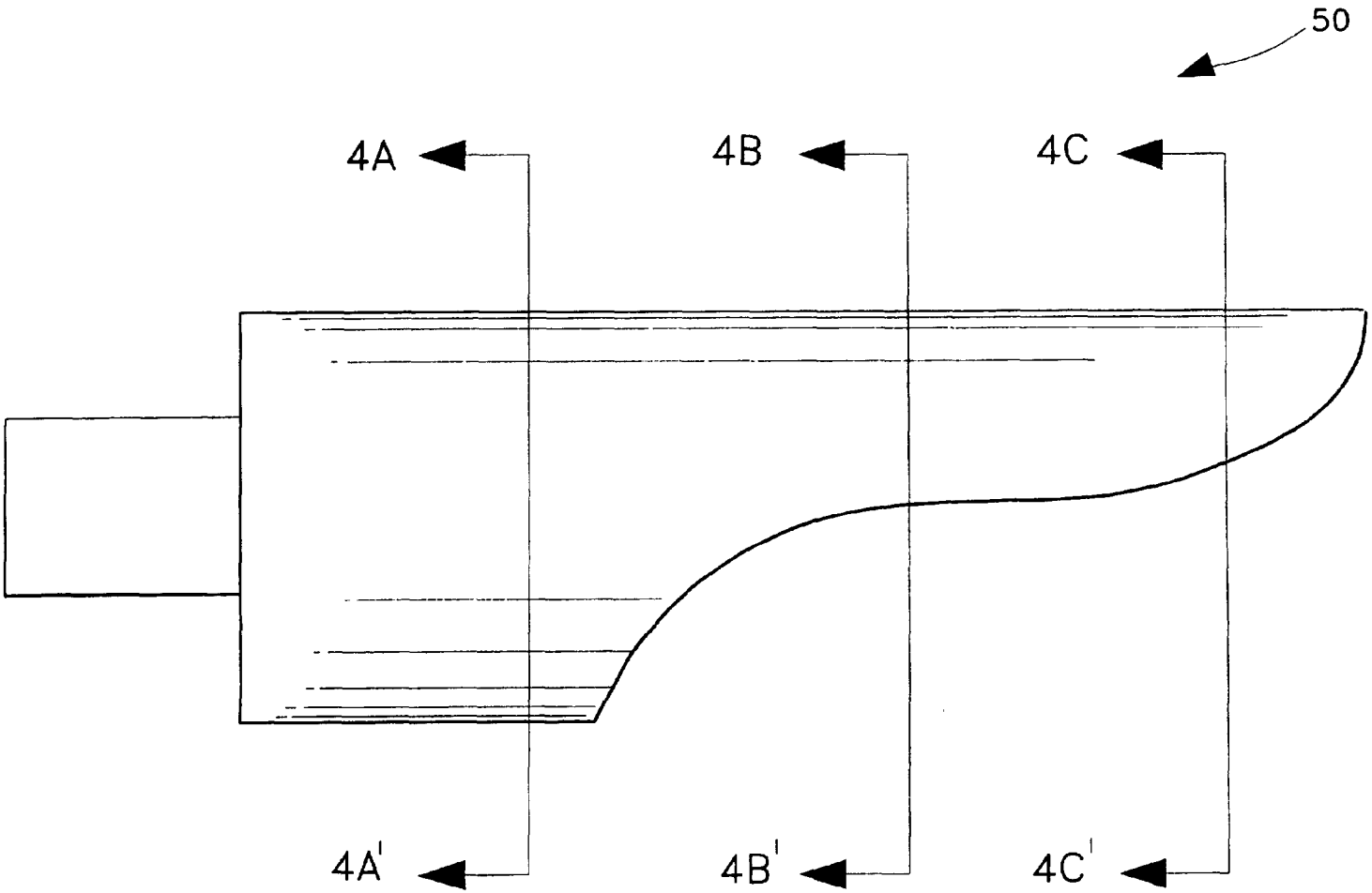
FIG. 4 is a side view of a first example of a landscape light shroud according to the present invention.
Figure 4A:
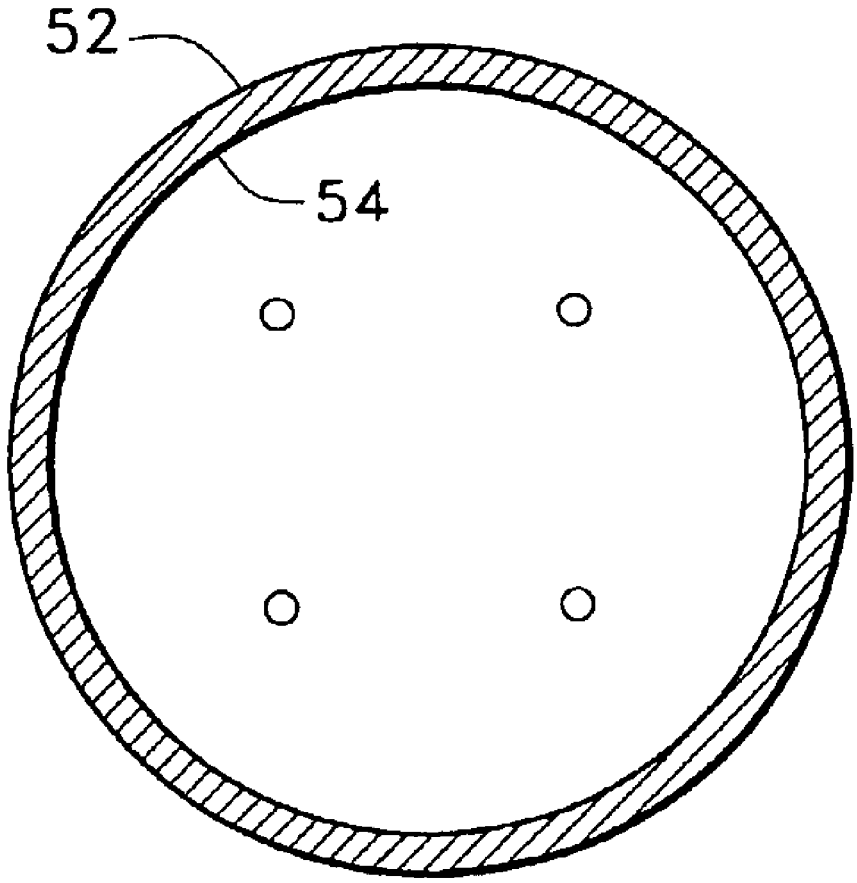
FIGS. 4A, 4B, and 4C are cross-sectional views of the landscape light shroud shown in FIG. 4 along lines A–A', B–B', and C–C' respectively.
Figure 4B:
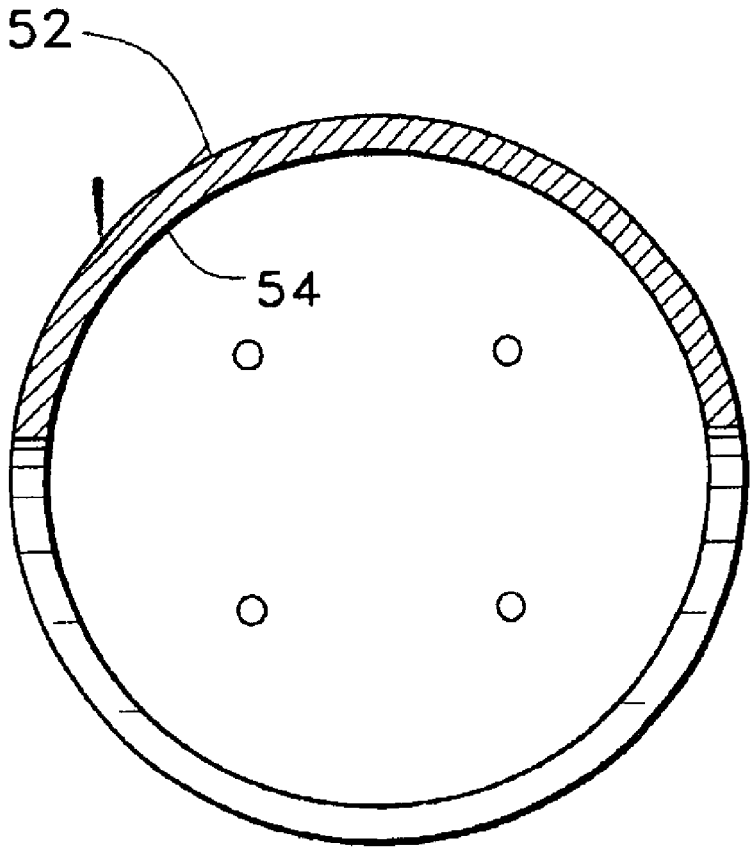
Figure 4C:
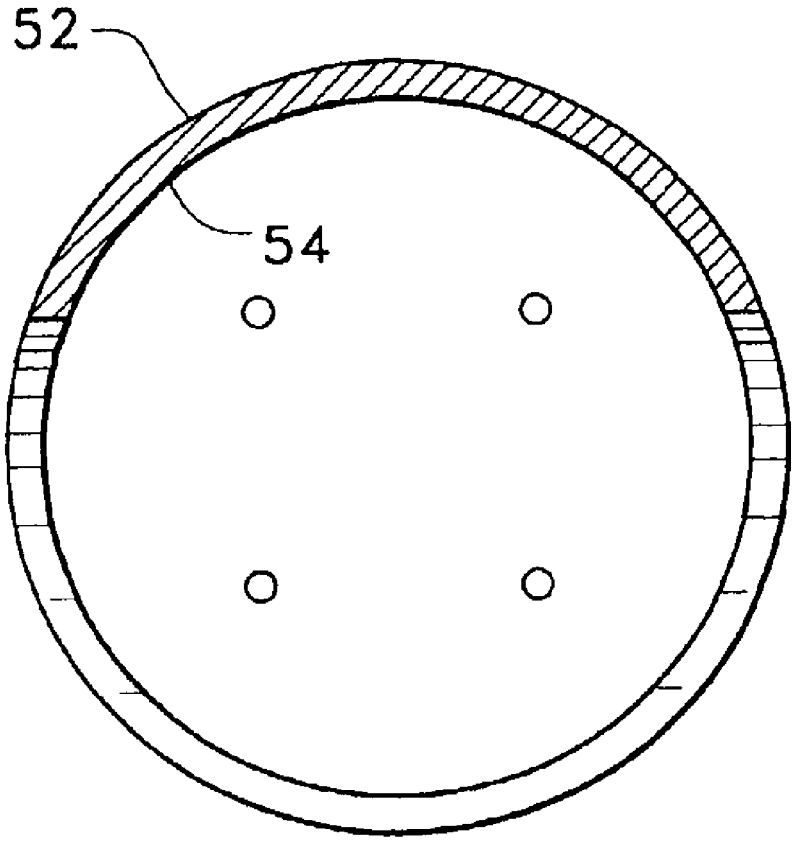

FIG. 4 is a side view of a first example of a landscape light shroud 50 according to the present invention. FIGS. 4A, 4B, and 4C are cross-sectional views of landscape light shroud 50 shown in FIG. 4 along lines A–A', B–B', and C–C' respectively. Landscape light shroud 50 includes an outer surface 52 and an inner surface 54 is configured to allow light emitted a light bulb to be directed downward. Reflective material may be attached to the inner surface 54 of landscape light shroud 50 to reflect light from a light bulb to the environment.

Figure 5:
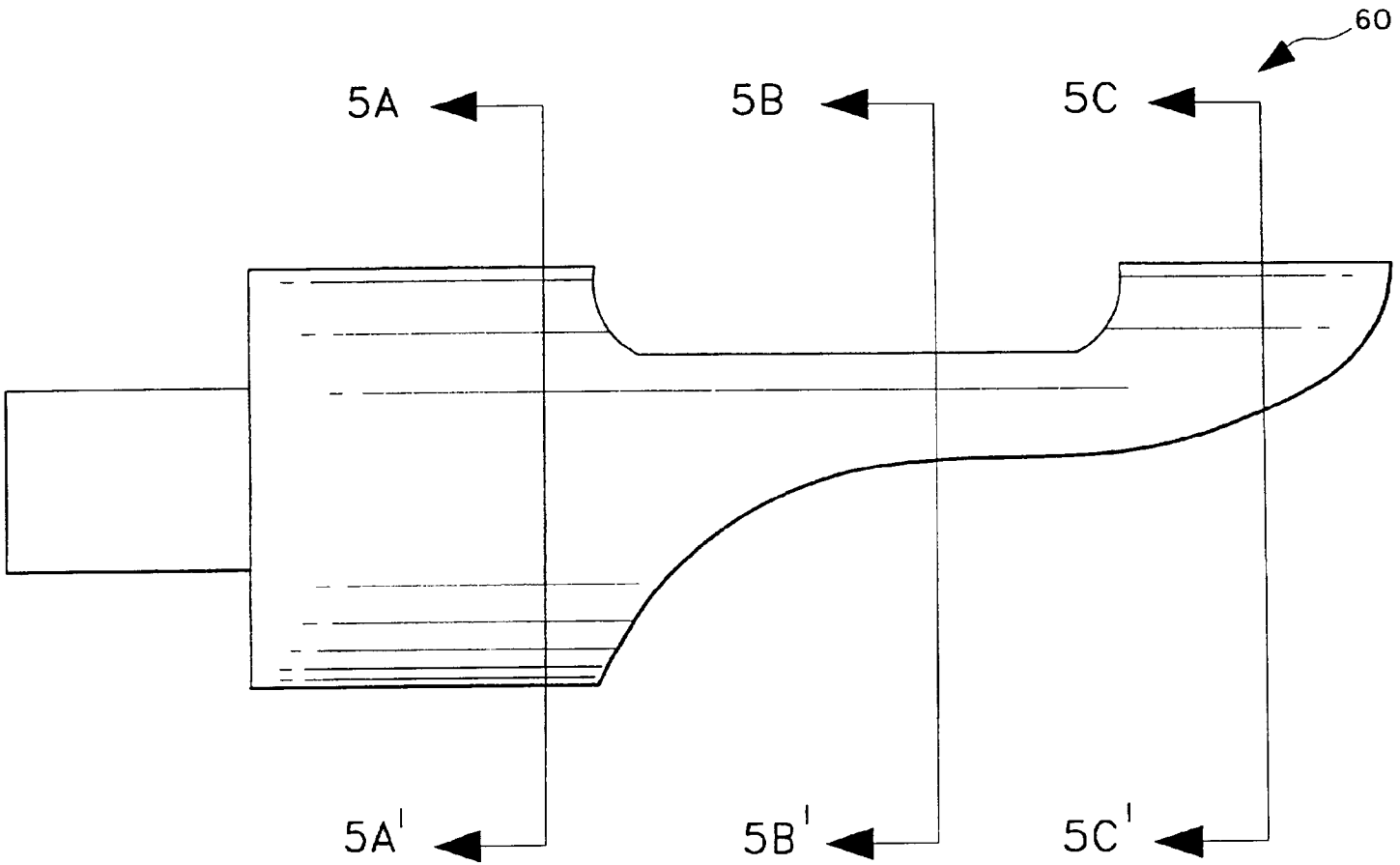
FIG. 5 is a side view of a second example of a landscape light shroud according to the present invention.
Figure 5A:
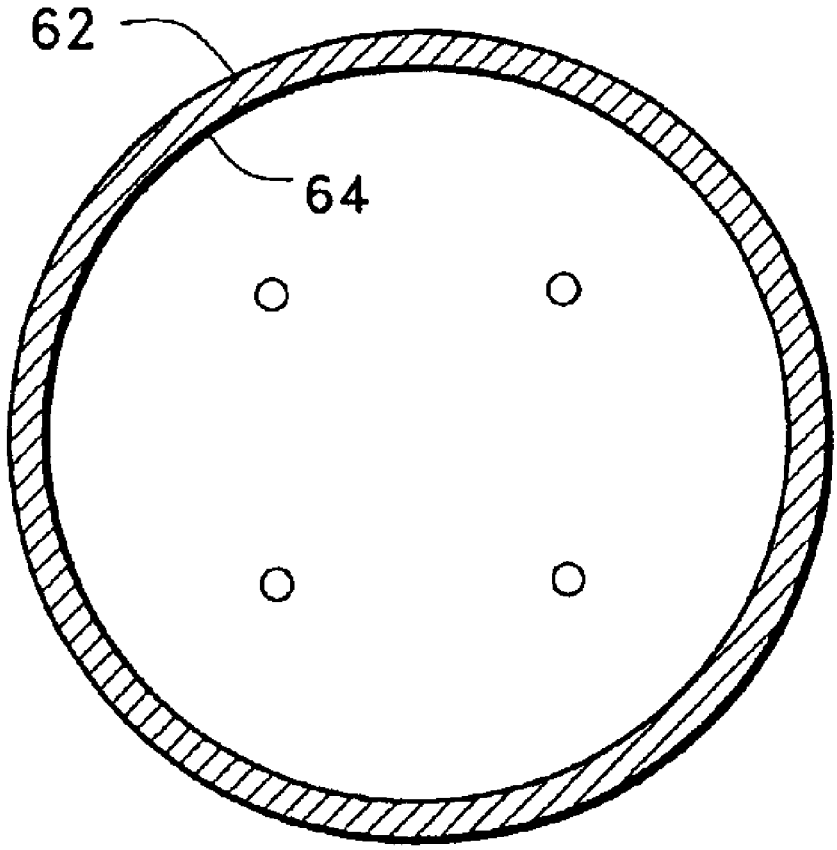
FIGS. 5A, 5B, and 5C are cross-sectional views of the landscape light shroud shown in FIG. 5 along lines A–A', B–B', and C–C' respectively.
Figure 5B:
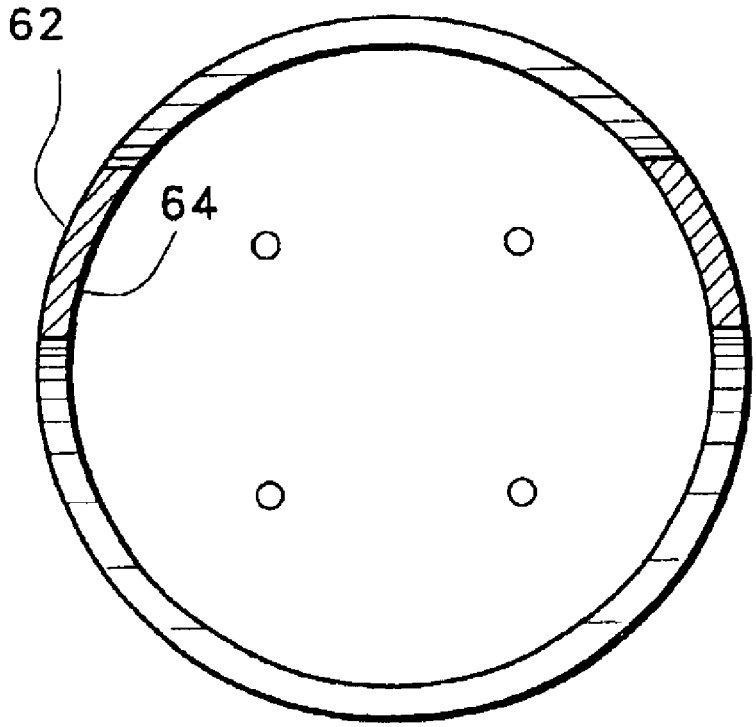
Figure 5C:
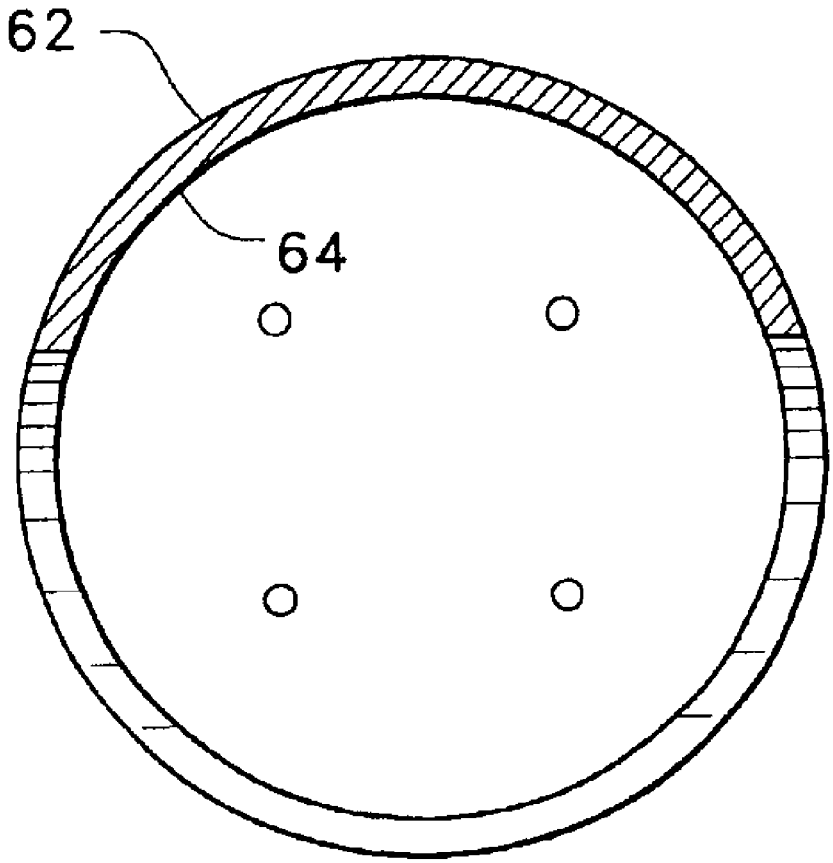

FIG. 5 is a side view of a second example of a landscape light shroud 60 according to the present invention. FIGS. 5A, 5B, and 5C are cross-sectional views of landscape light shroud 60 shown in FIG. 5 along lines A–A', B–B', and C–C' respectively. Landscape light shroud 60 includes an outer surface 62 and an inner surface 64 is configured to allow light emitted a light bulb to be directed upward and downward. Reflective material may be attached to the inner surface 54 of landscape light shroud 60 to reflect light from a light bulb to the environment.

Figure 6:
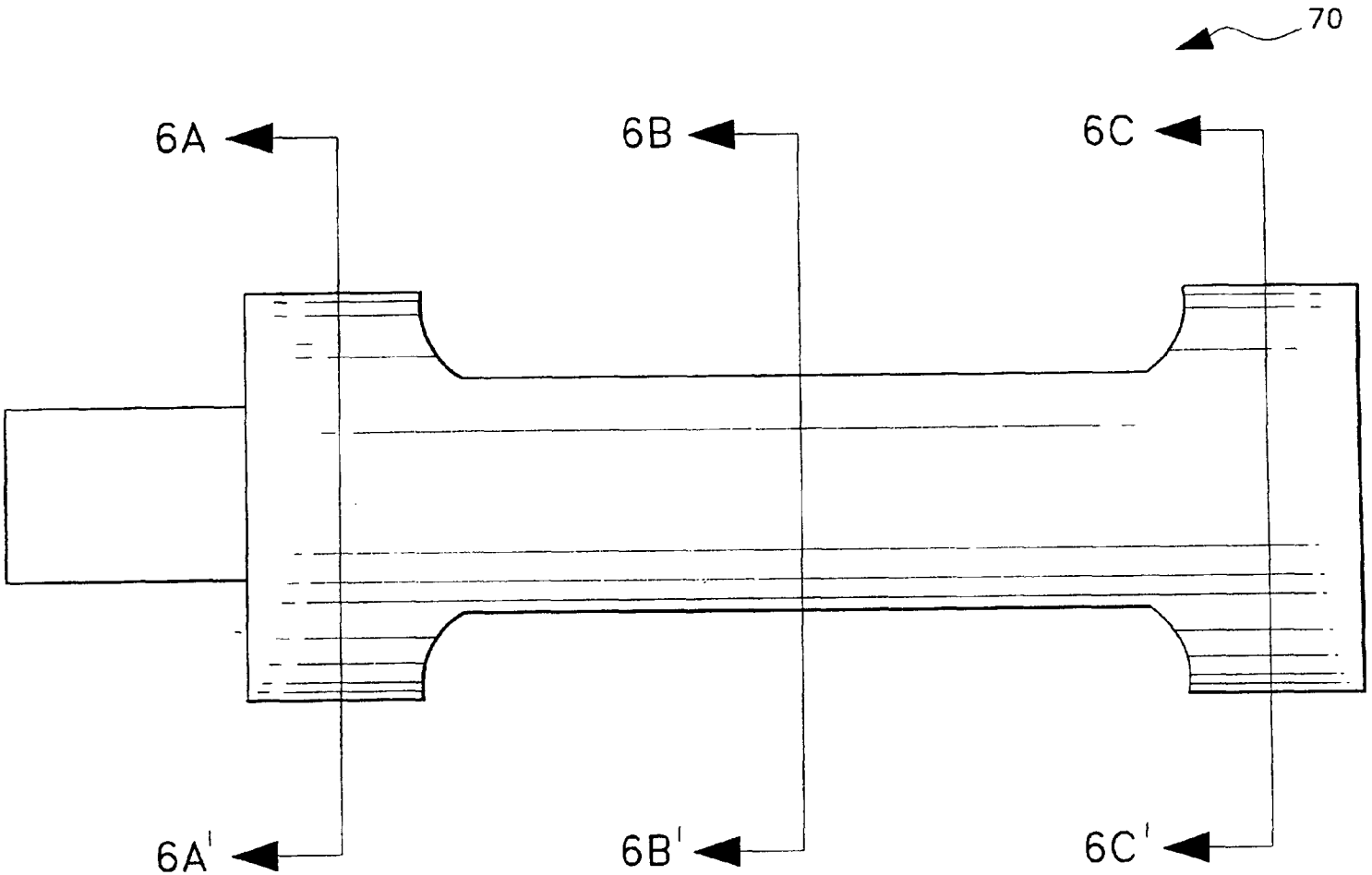
FIG. 6 is a side view of a third example of a landscape light shroud according to the present invention.
Figure 6A:
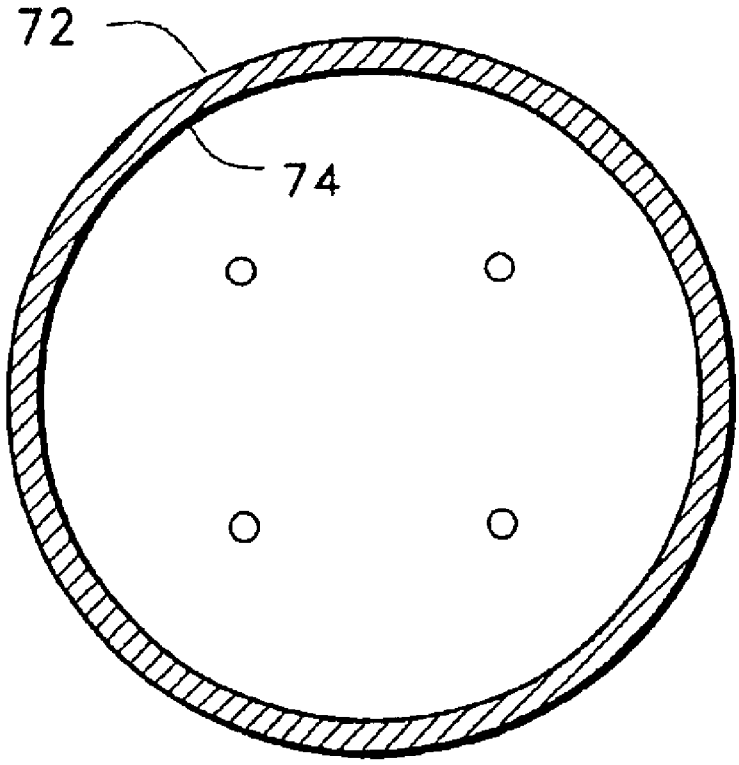
FIGS. 6A, 6B, and 6C are cross-sectional views of the landscape light shroud shown in FIG. 6 along lines A–A', B–B', and C–C' respectively.
Figure 6B:
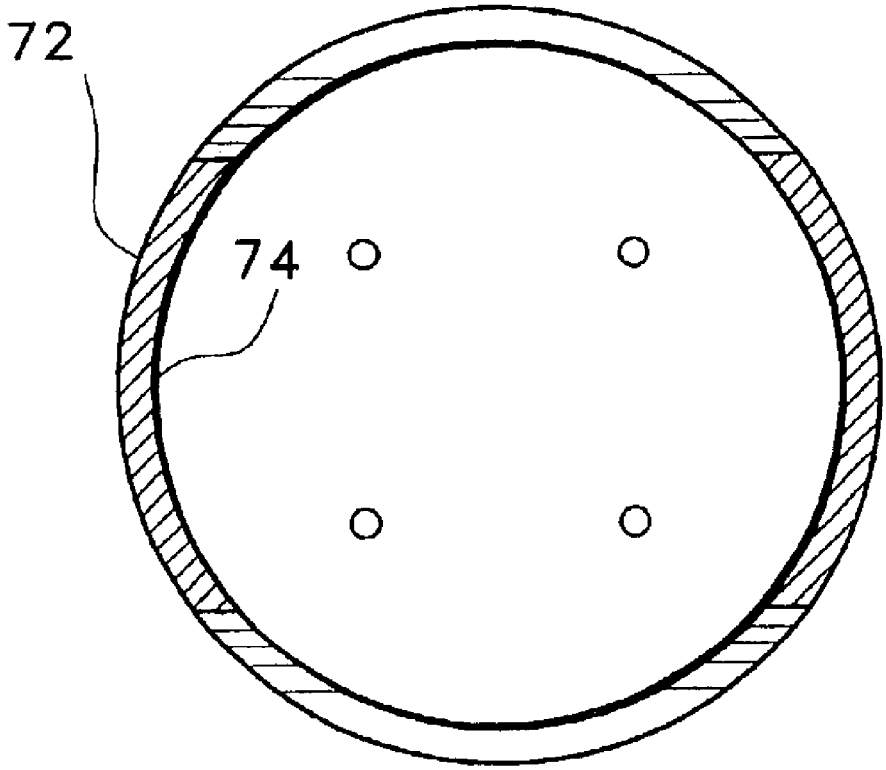
Figure 6C:
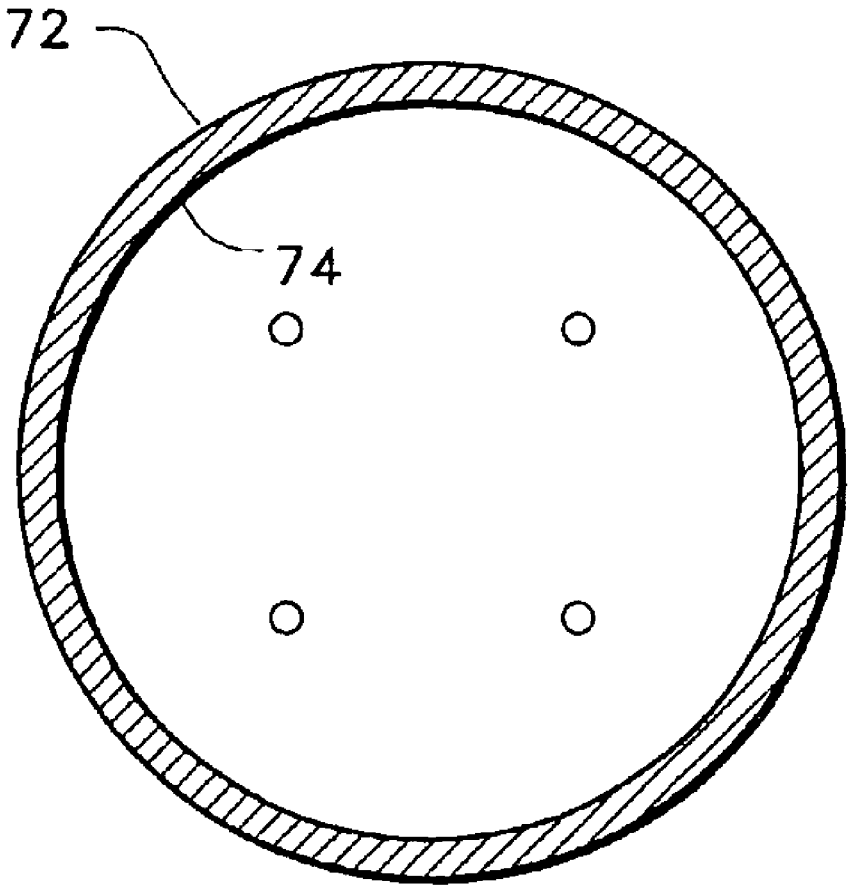

FIG. 6 is a side view of a third example of a landscape light shroud 70 according to the present invention. FIGS. 6A, 6B, and 6C are cross-sectional views of landscape light shroud 70 shown in FIG. 6 along lines A–A', B–B', and C–C' respectively. Landscape light shroud 70 includes an outer surface 72 and an inner surface 74 is configured to allow light emitted a light bulb to be directed upward and downward. Reflective material may be attached to the inner surface 74 of landscape light shroud 70 to reflect light from a light bulb to the environment.

Figure 7:
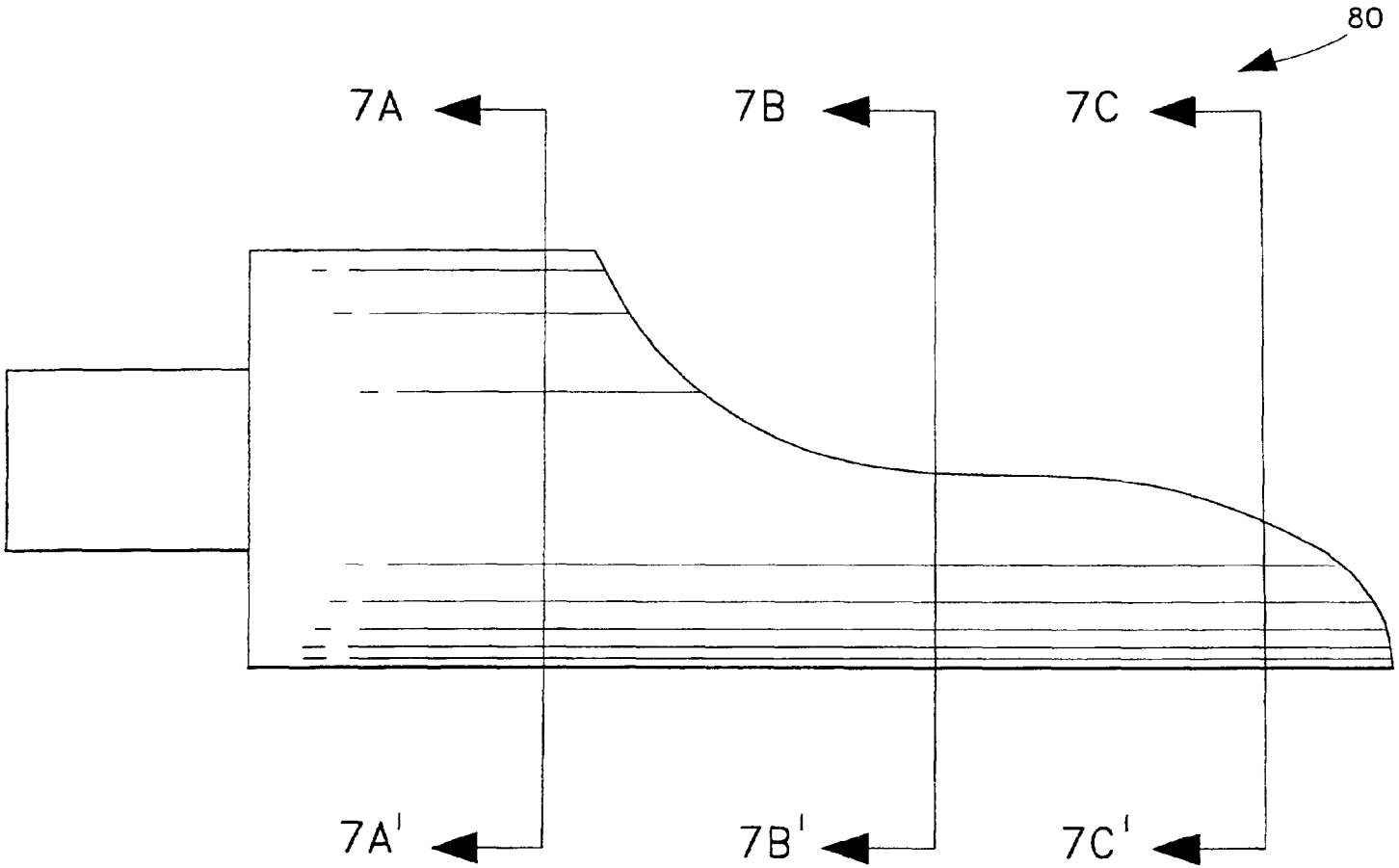
FIG. 7 is a side view of a fourth example of a landscape light shroud according to the present invention.
Figure 7A:
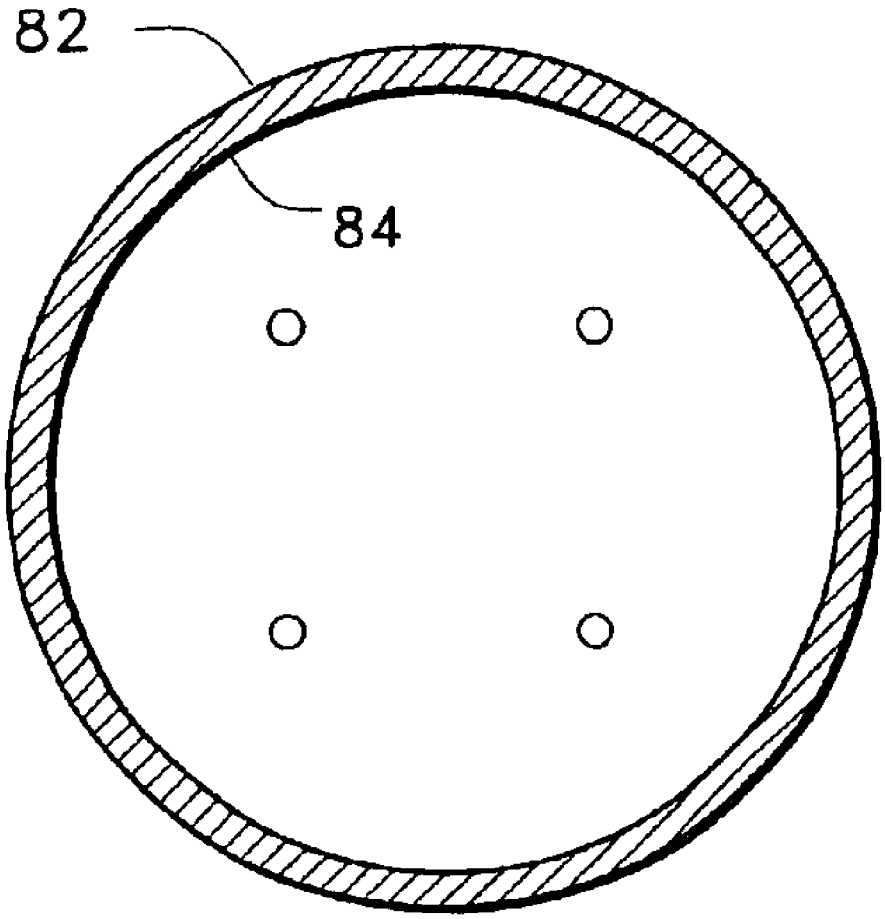
FIGS. 7A, 7B, and 7C are cross-sectional views of the landscape light shroud shown in FIG. 7 along lines A–A', B–B', and C–C' respectively.
Figure 7B:
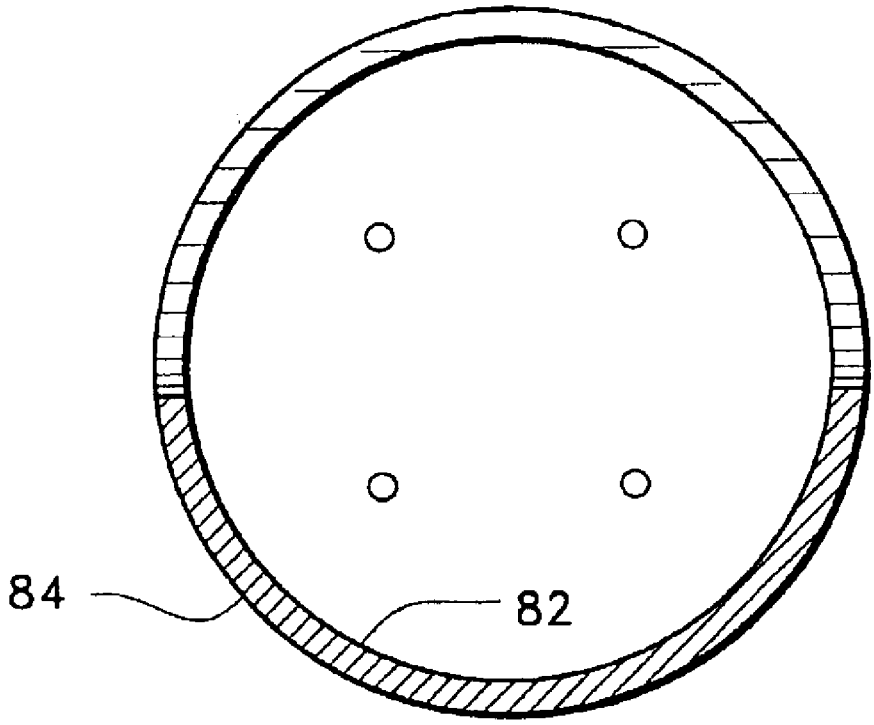
Figure 7C:
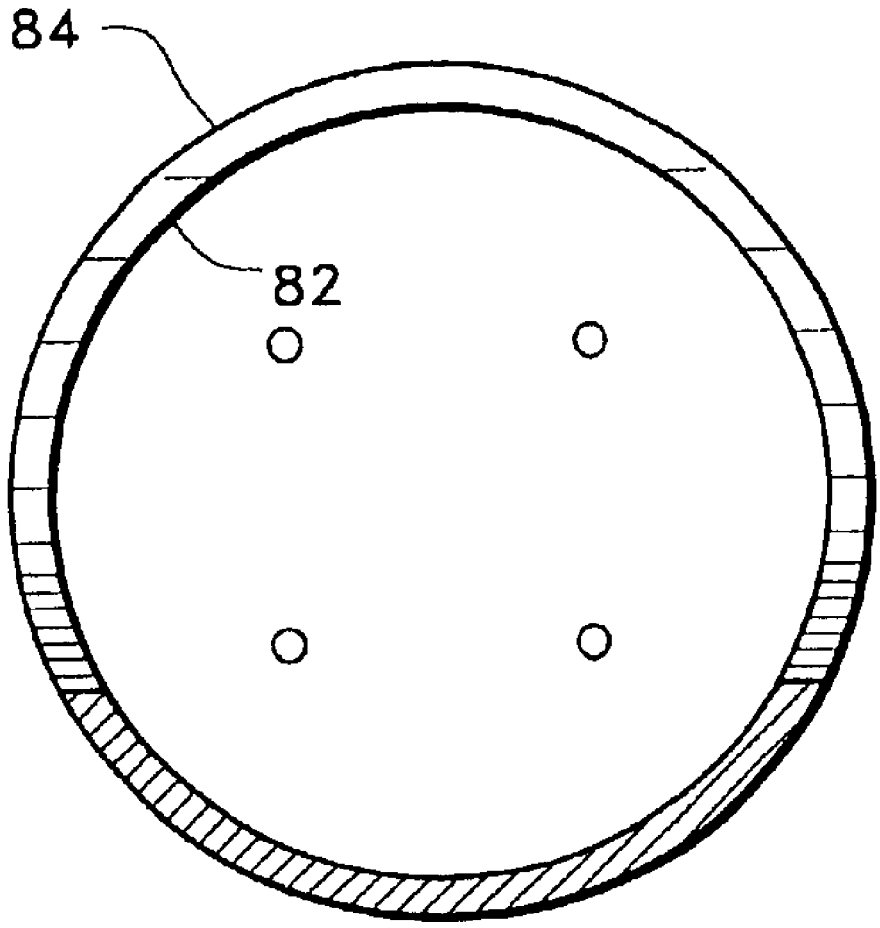

FIG. 7 is a side view of a fourth example of a landscape light shroud 80 according to the present invention. FIGS. 7A, 7B, and 7C are cross-sectional views of landscape light shroud 80 shown in FIG. 7 along lines A–A', B–B', and C–C' respectively. Landscape light shroud 80 includes an outer surface 82 and an inner surface 84 is configured to allow light emitted from a light bulb to be directed upward. Reflective material may be attached to the inner surface 84 of landscape light shroud 80 to reflect light from a light bulb to the environment.

Figure 8:
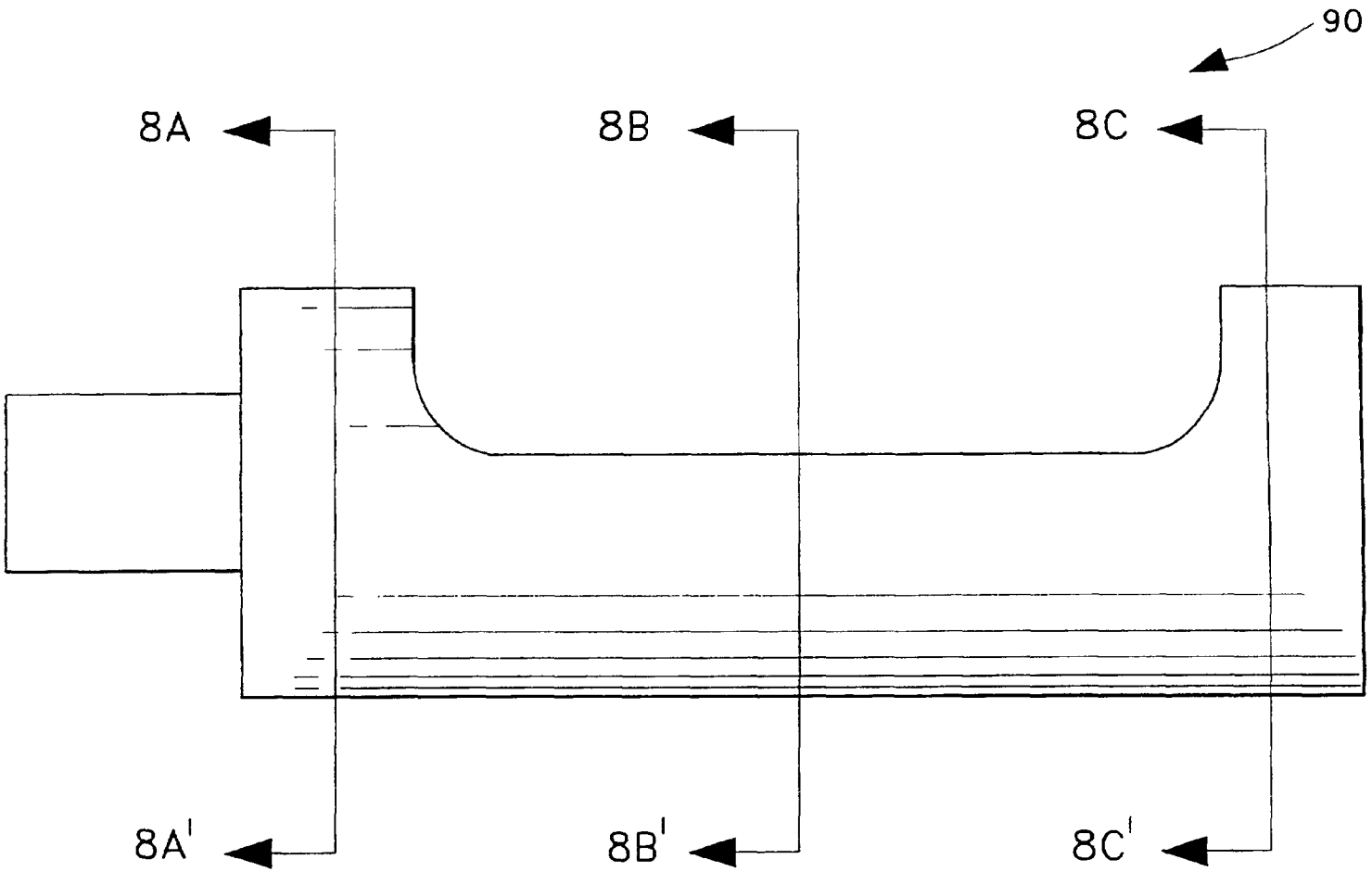
FIG. 8 is a side view of a fifth example of a landscape light shroud according to the present invention.
Figure 8A:
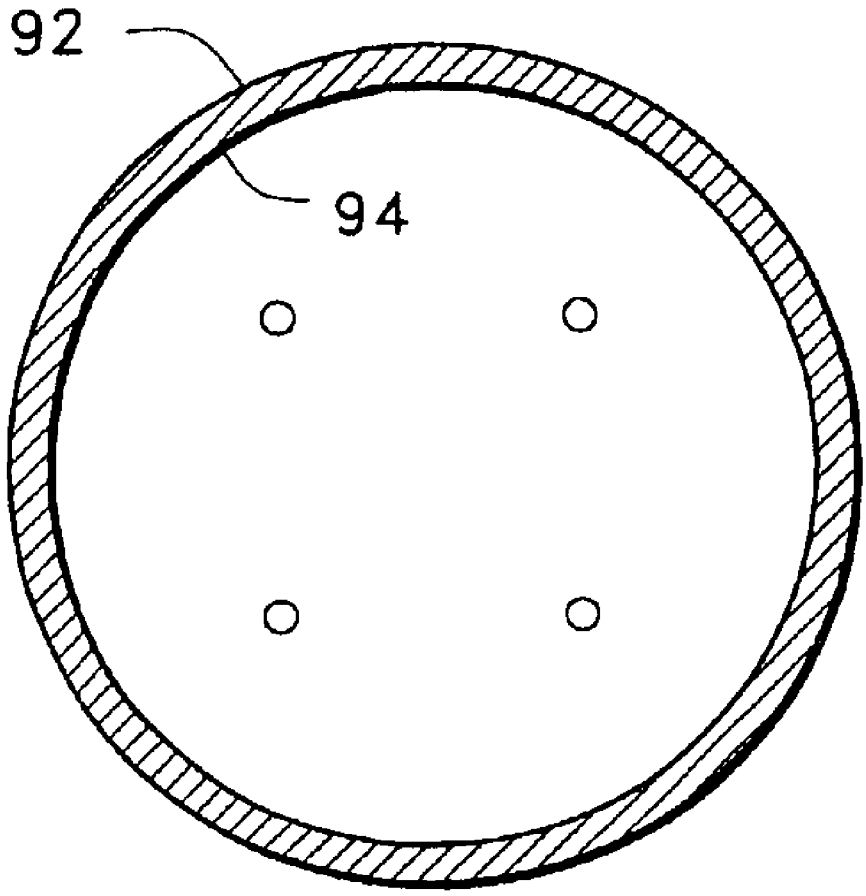
FIGS. 8A, 8B, and 8C are cross-sectional views of the landscape light shroud shown in FIG. 8 along lines A–A', B–B', and C–C' respectively.
Figure 8B:
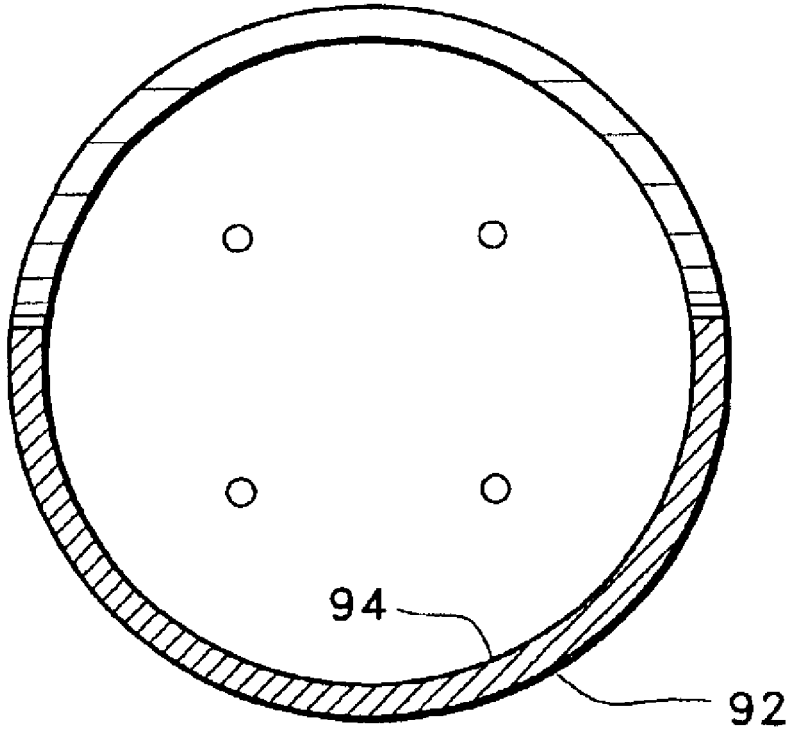
Figure 8C:
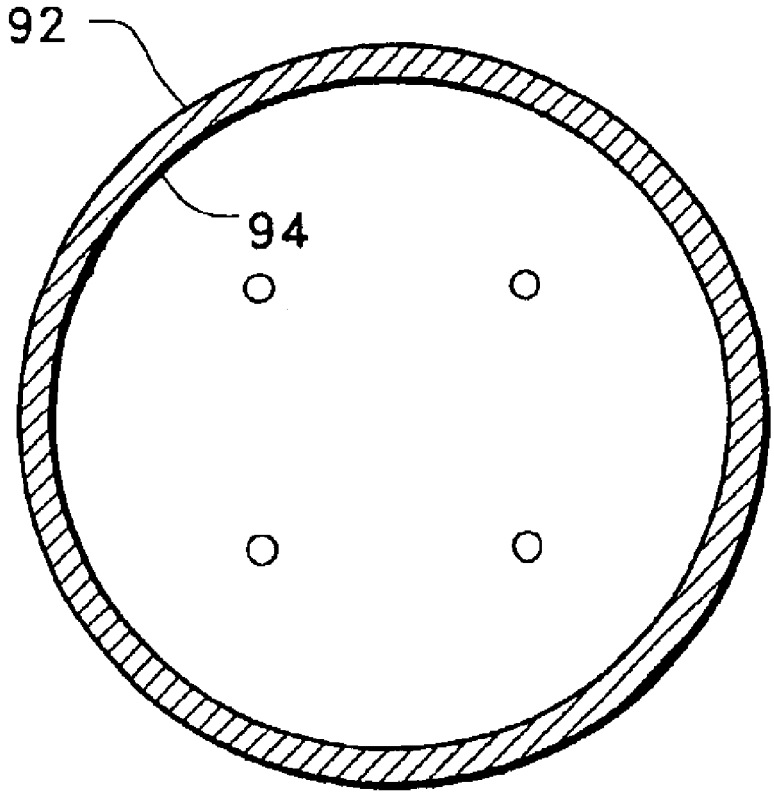

FIG. 8 is a side view of a fifth example of a landscape light shroud 90 according to the present invention. FIGS. 8A, 8B, and 8C are cross-sectional views of landscape light shroud 90 shown in FIG. 8 along lines A–A', B–B', and C–C' respectively. Landscape light shroud 90 includes an outer surface 92 and an inner surface 94 is configured to allow light emitted a light bulb to be directed upward. Reflective material may be attached to the inner surface 94 of landscape light shroud 90 to reflect light from a light bulb to the environment.

Figure 9A:
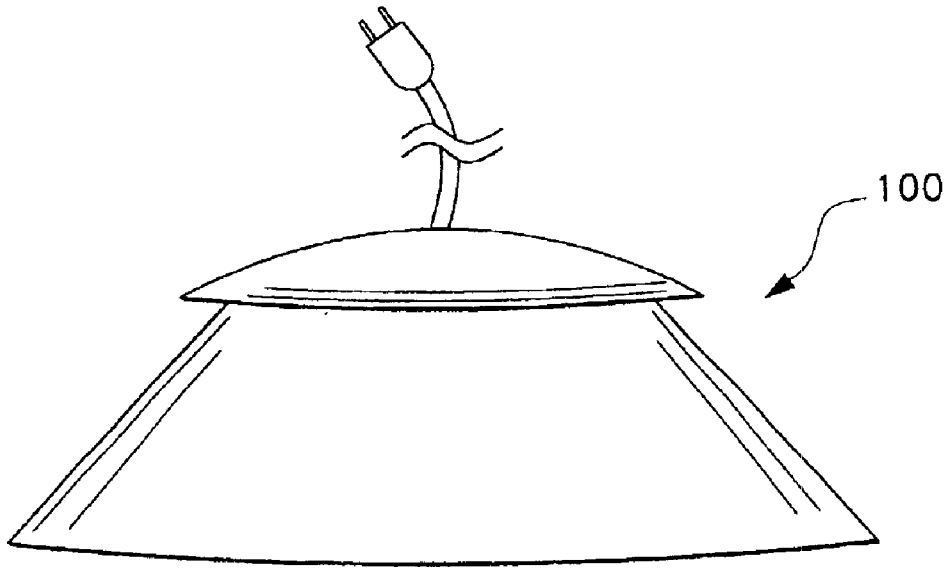
FIG. 9A is a side view of an example of a hanging landscape light fixture according to the present invention.
Figure 9B:
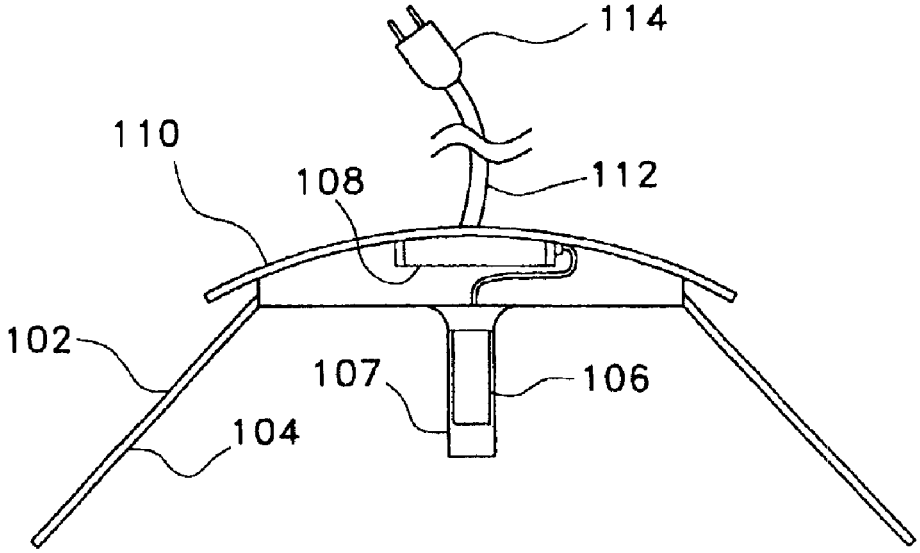
FIG. 9B is a cross-sectional view of the hanging landscape light fixture shown in FIG. 9A.

FIG. 9A is a side view of an example of a hanging landscape light fixture 100 according to the present invention. FIG. 9B is a cross-sectional view of hanging landscape light fixture 100 shown in FIG. 9A. Landscape light fixtures 100 is a hanging light fixture. Landscape light fixture 100 includes a ballast housing 110, a shroud 102, a light bulb 106, a lens 107, and a power cord 112 with a connector 114.

Ballast housing 110 is configured to house a ballast or power stabilizing circuit 108 that converts externally received power to a predetermined form for the landscape light fixture. For example, 12 volt, 60 Hz power provided from electrical power cord 112 and connector 114 by an external power source may be converted into a high frequency AC form for the landscape light fixture by the ballast. Ballast housing 110 may be made of any durable material according to the desires of the user. For example, ballast housing 110 may be made of decorative metal material, such as copper or the like, or decorative plastic material.

Shroud 102 includes a base through which an electrical conductor passes and connects to a light socket (not shown). The base may include apertures defined therein that allow one or more fastening elements (not shown) to pass therethrough. A transparent or translucent cylindrically shaped lens 107 is attached to the base and extends for a predetermined distance from the base. Lens 107 protects light bulb 106 from environmental damage and may be made of rugged polycarbonate material, such as LEXAN or the like, and may be colored according to the desires of the user.

Shroud 102 includes a longitudinally extending member from the base. This member includes an outer surface and an inner surface 104. This member is configured in the form of a light shade to allow light emitted from light bulb 106 to be directed downward according to the desires of the user. Reflective material may be attached to the inner surface 104 of light shroud 102 to reflect light from light bulb 106 to the environment.

Light bulb 106 may be a fluorescent light to produce aesthetic lighting to a landscape area. For example, light bulb 106 may be configured to produce moonlight lighting to the backyard of a residence. Light bulb 106 may be a cylindrical glass element with an electrical connector at one end configured to electrically connect to the light socket of the shroud. Light bulb 106 may be dimensioned according to the desires of the user.

Power cord 112 enables landscape light fixture 100 to receive external power through an external power cord 112 and connector 114.

While the invention has been described with references to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

I claim:

1. A landscape light fixture comprising:

a ballast housing with a front end, a rear end, and a side, wherein the front end and rear end of the ballast housing include a apertures defined therein to allow at least one mounting element to pass therethrough to mount the ballast housing to a support;

a ballast mounted within the ballast housing;

a shroud interconnected with the ballast;

a light bulb electrically connected to the ballast and contained within the shroud;

a lens covering the light bulb; and, a power cord with a connector electrically connected to the ballast.

2. The landscape light fixture according to claim 1, wherein the ballast housing is made of durable material.

3. The landscape light fixture according to claim 1, further comprising at least one mounting element to pass through said apertures to mount the ballast housing to a support.

4. The landscape light fixture according to claim 1, wherein the light bulb is a fluorescent light to produce aesthetic lighting.

5. The landscape light fixture according to claim 4, wherein the aesthetic lighting is moonlight.

6. The landscape light fixture according to claim 1, further comprising a neck that interconnects the ballast housing with the shroud.

7. The landscape light fixture according to claim 6, wherein one end of the neck includes a flexible portion configured to allow adjustment of the light.

8. The landscape light fixture according to claim 1, wherein the lens is cylindrically shaped.

9. The landscape light fixture according to claim 8, wherein the lens is transparent.

10. The landscape light fixture according to claim 8, wherein the lens is translucent.

11. The landscape light fixture according to claim 8, wherein the lens is colored.

12. The landscape light fixture according to claim 1, wherein the shroud includes an inner surface and an outer surface.

13. The landscape light fixture according to claim 12, wherein reflective material is attached to the inner surface of the shroud to reflect light from the light bulb to the environment.

14. The landscape light fixture according to claim 12, wherein the shroud directs light emitted from the light bulb upward.

15. The landscape light fixture according to claim 12, wherein the shroud directs light emitted from the light bulb downward.

16. The landscape light fixture according to claim 12, wherein the shroud directs light emitted from the light bulb upward and downward.

17. The landscape light fixture according to claim 12, wherein the shroud includes a base through which electrical conductors pass and connect to a light socket.

* * * * *